US005197869A

United States Patent [19]

Hansen et al.

[11] Patent Number: 5,197,869

[45] Date of Patent: Mar. 30, 1993

[54] ROTARY GEAR TRANSFER PUMP HAVING PRESSURE BALANCING LUBRICATION, BEARING AND MOUNTING MEANS

[75] Inventors: Milton N. Hansen; Steven D. McMahon, both of Mansfield, Ohio

[73] Assignee: The Gorman-Rupp Company, Mansfield, Ohio

[21] Appl. No.: 673,948

[22] Filed: Mar. 22, 1991

[51] Int. Cl.[5] ..... F04C 2/10; F04C 15/00

[52] U.S. Cl. ..... 418/77; 418/102; 418/104; 418/170; 418/270

[58] Field of Search ..... 418/77, 102, 104, 166–171, 418/270

[56] References Cited

U.S. PATENT DOCUMENTS

| | | | |
|---|---|---|---|
| 1,739,139 | 12/1929 | Haight | 418/169 |
| 1,994,397 | 3/1935 | Loveridge et al. | 418/169 |
| 2,124,140 | 7/1938 | Foster et al. | 418/169 |
| 2,615,399 | 10/1952 | Edwards | 418/169 |
| 2,940,399 | 6/1960 | Zieg et al. | 418/169 |
| 2,998,783 | 9/1961 | Lee | 418/169 |
| 3,015,282 | 1/1962 | Camarata | 418/102 |
| 3,152,551 | 10/1964 | Peters | 418/169 |
| 3,233,552 | 2/1966 | Kinnavy | 418/169 |
| 3,303,783 | 2/1967 | Neubauer . | |
| 3,303,784 | 2/1967 | Neubauer . | |
| 3,374,748 | 3/1968 | Marsh . | |
| 3,427,983 | 2/1969 | Brundage . | |
| 3,574,489 | 4/1971 | Pierrat | 418/171 |
| 3,730,656 | 5/1973 | Lambeth | 418/170 |
| 3,738,784 | 6/1973 | Clark et al. | 418/270 |
| 3,758,244 | 9/1973 | Gerber | 418/169 |
| 3,759,639 | 9/1973 | Molly | 418/170 |
| 3,779,674 | 12/1973 | Eckerle et al. | 418/170 |
| 3,825,377 | 7/1974 | Bottoms | 418/170 |
| 3,876,349 | 4/1975 | Svensson | 418/169 |
| 3,887,310 | 6/1975 | Gerber | 418/169 |
| 3,907,465 | 9/1975 | Dorff et al. | 418/171 |
| 4,199,305 | 4/1980 | Pareja | 418/171 |
| 4,392,799 | 7/1983 | Shikano et al. | 418/170 |
| 4,780,071 | 10/1988 | Buchmüller | 418/169 |

FOREIGN PATENT DOCUMENTS

| | | | |
|---|---|---|---|
| 1553024 | 4/1970 | Fed. Rep. of Germany | 418/170 |
| 2614239 | 10/1977 | Fed. Rep. of Germany | 418/270 |
| 63-195391 | 8/1988 | Japan | 418/171 |

*Primary Examiner*—John J. Vrablik

*Attorney, Agent, or Firm*—Watts, Hoffman, Fisher & Heinke

[57] ABSTRACT

An externally driven rotor is rotatable within a pumping chamber and is located in meshing relationship with an internal idler gear. An annular bearing mounted within the housing in confronting relationship with a peripheral surface of the rotor, provides a bearing surface and supports radially directed loads exerted by unbalanced fluid force on the rotor. A pressure balancing circuit is provided for transferring pressurized fluid from a discharge region in the pump to a backside of the rotor to at least partially balance axial forces exerted on the rotor by pressurized fluid. To provide bi-rotational capability, a cross-communicating passage and check valves are used for controlling the flow of fluid into the pressure balancing circuit. A vented seal chamber is also provided which includes passages and check valves communicating with ports which are arranged such that when the seal chamber exceeds inlet pressure, the check valve associated with the port acting as an inlet opens to discharge fluid from the seal chamber. A replaceable foot bracket is provided so that the mounting height of the pump can be selected to coincide with a mounting height of a drive motor to which it is connected eliminating the need for shims or other adjustments. An alternate rotor is disclosed including trimmed regions for reducing viscous friction when pumping high viscus fluids.

21 Claims, 4 Drawing Sheets

ROTARY GEAR TRANSFER PUMP HAVING PRESSURE BALANCING LUBRICATION, BEARING AND MOUNTING MEANS

TECHNICAL FIELD

The present invention relates generally to fluid pumps and in particular to a "gear within a gear" type transfer pump.

BACKGROUND ART

Transfer pumps of the "gear within a gear" configuration are used in many applications to pump fluids at relatively high flow rates at relatively low pressures (less than 500 psi) as compared to hydraulic system pumps which often operate at pressures well in excess of 1000 psi. This type of transfer pump, usually includes an internal crescent positioned between an outer, driven gear (alternately termed a "rotor") and a smaller, idler gear. The outer gear is connected to a shaft that extends through the housing and is attached directly or indirectly to a drive motor. The idler gear rotates about a fixed idler pin and is driven by the outer gear, as distinguished from a "gerotor" type of gear pump in which an "outer gear" includes inwardly directed teeth that mesh with, and are driven by, an internal drive gear.

A gear within a gear type of transfer pump is called upon to perform a wide variety of tasks in a wide variety of environments. Due to the configuration of the pump, the outer gear or rotor is subjected to unbalance loads especially when the pump is operating at several hundred psi. The unbalanced load is due to the discharge pressure which exerts a radial load on only a portion of the rotor (the portion that is travelling through the discharge or outlet region of the pump) as opposed to a uniform force across the entire rotor. At high pressures, it has been found that the drive shaft to which the rotor is connected, is subjected to bending loads (due to the discharge pressure generated force) sufficient to produce radial movement in the rotor. As a result, the clearance between the outer gear and the housing must be relatively high in order to accommodate the expected deflection in the shaft at high operating pressures. Alternately, the pump must be operated at reduced pressures.

In most conventional transfer gear pumps of this type, the maximum operating pressure that the pump can operate at is limited by the load that can be supported by the shaft bearing. In this type of pump, the fluid being pumped exerts an axial force on the outer rotor that is transferred to the drive shaft. Loads on the drive shaft are in turn transmitted to the shaft bearing. In conventional pumps, in order to accommodate higher pumping pressures, shaft bearings have to be increased in sized or improved in order to support the increase in mechanical load caused by the higher operating pressure.

DISCLOSURE OF THE INVENTION

The present invention provides a new and improved "gear within a gear" transfer pump which is capable of operating at relatively high pressures (as compared to more conventional transfer pumps) and which is adaptable to a wide variety of applications and mounting configurations.

According to the invention, the transfer pump includes a pump casing including a "pump head", a rotor housing defining a pumping chamber and a shaft housing, sometimes termed a "backhead." The pumping chamber defined by the rotor housing includes a circular portion for receiving a rotor rotatable within the circular portion. The rotor includes a plurality of peripheral teeth extending axially from a skirt. A drive shaft extends axially from the skirt and is rotatably supported by the backhead. The backhead defines a seal chamber which may include a seal for sealingly engaging the shaft to inhibit fluid leakage out of the rotor housing.

According to the invention, the pumping chamber communicates with a pair of ports, one of which serves as the inlet whereas the other serves as the outlet. A fixed idler pin extends into the chamber and rotatably supports an idler gear that is located in meshing relationship with the rotor. In the preferred and illustrated embodiment, a crescent is positioned between a peripheral portion of the idler gear and the teeth of the rotor. As is conventional, rotation of the rotor produces concurrent rotation in the idler gear which causes fluid to be drawn from the inlet and transferred under pressure through the pumping chamber and to the outlet.

According to one feature of the invention, a rotor bearing is disposed in the pump chamber and provides a bearing surface for a radial, peripheral surface of the rotor. The disclosed bearing directly supports unbalanced forces exerted on the rotor by the fluid being pumped, which in prior art pumps could produce shaft deflection and attendant wear in the pump housing especially when operating the pump at high pressures.

In the preferred and illustrated embodiment, the annular rotor bearing is constructed from a teflon-bronze-steel composition (TBS) which is a steel backed, teflon impregnated bronze element.

As indicated above, in prior constructions, radial loads exerted on the rotor by the fluid pressure at the discharge port was borne by a shaft bearing. At high pressures, shaft deflection would occur allowing the rotor to engage portions of the pump chamber wall at high load causing wear in the rotor and/or pump housing. With the disclosed construction, a bearing surface is provided for the rotor that supports loads due to shaft deflection and in the preferred construction, the bearing is a replaceable wear item allowing the pump to be repaired without necessitating replacement of the rotor housing.

A shaft bushing is disposed between the pumping chamber and the seal chamber and also rotatably supports the shaft near the rotor. The shaft bushing is typically of a much smaller diameter than the rotor itself. With the current construction, the per unit loading of the annular rotor bearing is substantially less than the unit loading of a shaft bushing in a prior art construction since the annular rotor bearing is of substantially greater diameter and has a much greater bearing area in contact with the rotor as compared to the contact are of the shaft bushing and shaft.

According to another feature of the invention, a pressure balancing passage is provided for communicating at least some pressure from the pumping chamber to the backside of the rotor in order to counter the axial force exerted on the face of the rotor by fluid in the pumping chamber. According to this feature, a passage is formed in the idler pin which communicates with fluid at the discharge port of the pump. The passage is relatively small and provides a restricted flow of fluid from the discharge port along the idler pin and is discharged into a region defined between the idler gear and a central portion of the rotor. A passage is formed in the rotor and/or rotor shaft which communicates fluid in the region to the backside of the rotor where the fluid exerts an axial force on the rotor which at least partially counters the axial force exerted by fluid pressure at the outlet.

According to a further aspect of this feature, the shaft bushing located intermediate the rotor chamber and the seal chamber acts as a throttle bushing. Preferably the bushing is sized to restrict flow from the backside of the rotor to the seal chamber.

According to still a further aspect of this feature of the invention, the passage for communicating fluid at the discharge port to the idler pin passage comprises a cross-communicating passage formed in the pump head having ends that communicate with associated ports. Check valves associated with each port are provided to allow fluid from a given port to proceed from the port into the passage while inhibiting reverse flow. The use of the cross passage and check valves allows the pump to be bi-rotational. With the disclosed construction, the check valve associated with the port acting as the outlet will pass fluid from the port into the cross passage. The same high pressure fluid communicated from the high pressure port will maintain closure of the other check valve to inhibit flow to the other port which acts as the inlet.

According to another feature of the invention, the seal chamber is vented to the inlet or suction port so that fluid leaking past the shaft bushing can be returned directly to the inlet pump stream. The disclosed vent ensures that high pressures are not developed in the seal region and thereby allows the use of lip seals to seal the shaft. It also ensures an exchange of fluid in the seal region. This feature is achieved without the need for a separate vent line for venting fluid to a reservoir tank or inlet port.

According to the preferred embodiment of this aspect of the invention, a passage is formed in the backhead, which communicates the seal chamber with the pump inlet/outlet ports. A check valve associated with each port allows fluid to flow from the seal chamber to a port while inhibiting reverse flow. The use of dual check valves allows the pump to be bi-rotational. In operation, fluid in the seal chamber will be discharged into the port acting as an inlet whenever the fluid pressure in the seal chamber exceeds check valve pressure. The fluid pressure at the discharge port will maintain closure of the check valve inhibiting fluid flow from the discharge port into the seal chamber.

According to still another feature of the invention, the pump includes a replaceable mounting element by which the mounting height of the pump can be adjusted and eliminate the need for spacing blocks and other accessories when mounting the pump in a given application. In most instances, the drive shaft of the pump is connected directly to the shaft of an electric drive motor. In order to couple the pump to the drive motor the axes of the pump shaft and motor shaft must be coincident.

Many, if not most prior art pumps of this type are built with an integrally formed foot or bracket. If the operating height provided by the bracket did not correspond to the motor height, spacing blocks were needed. Since electric drive motors come in industry standard frame sizes, the disclosed pump housing is adapted to mount a variety of mounting brackets which correspond to the frame size of the drive motor that is to be used to drive the pump. By selecting the proper bracket, the pump and drive motor axes will be aligned and no further major adjustments are required.

According to another feature of the invention, provision is made for "trimming" the rotor to improve the performance of the gear pump when pumping high viscous fluids. The disclosed trimming operation in cooperation with the annular bearing allows the pump to be run more efficiently without reducing its capacity or the maximum permissible operating pressure.

According to this feature of the invention, the teeth of the rotor are trimmed to provide added clearance between the peripheral surface of the teeth and the housing and a portion of the skirt is also trimmed to reduce the diameter and increase the clearance between the skirt and the housing. A region of the rotor intermediate the teeth and the skirt is left at the standard diameter and this region runs against the annular bearing so that the loads on the rotor are still borne by the annular bearing. The added clearance, however, between the teeth and an axial cavity wall portion and the skirt and the annular wall reduce viscous friction and hence reduce the power requirement for driving the pump.

According to the preferred embodiment of this feature, when a rotor is trimmed, the teeth are trimmed their full axial length. In the preferred embodiment, the radial clearance of the trimmed portion of the skirt is twice the radial clearance of the trimmed portion of the teeth.

The disclosed rotary transfer pump is capable of much higher operating pressures than its more conventional counterparts. In addition, this is achieved while providing a pump that is bi-rotational and which does not require disassembly or adjustments to change its pumping direction. The use of replaceable mounting brackets enables the pump to be mounted and connected to various drive motors without the need for adjustment blocks and/or spacers to provide the proper operating height. The mounting bracket supplied with a pump ensures that the nominal centerlines of the pump and drive motor match.

Additional features of the invention will become apparent and a fuller understanding obtained by reading the following detailed description made in connection with the accompanying drawings.

BEST MODE FOR CARRYING OUT THE INVENTION

Figure 1:
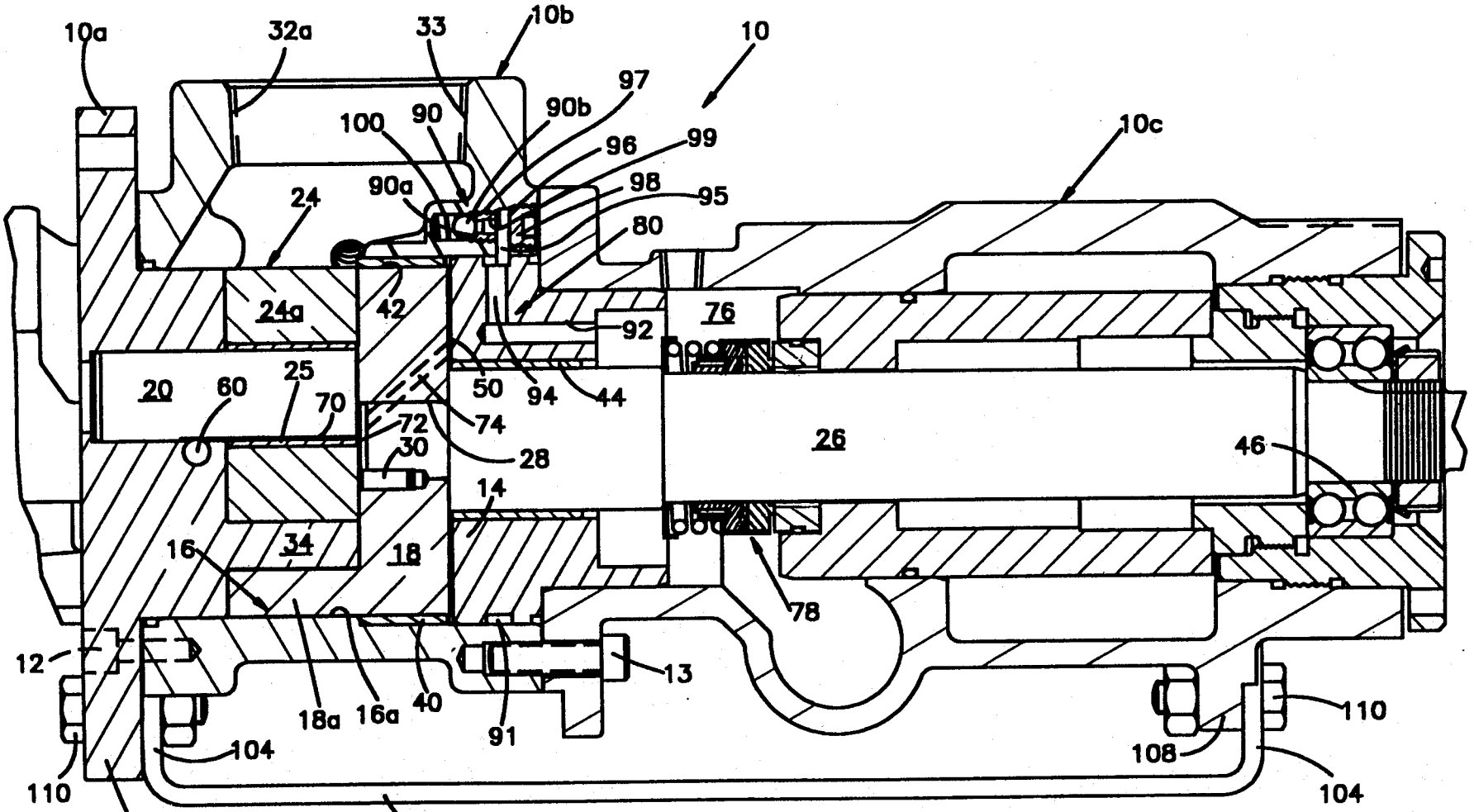
FIG. 1 is a sectional view of a gear within a gear, transfer pump constructed in accordance with the preferred embodiment of the invention.

FIG. 1 illustrates the overall construction of a transfer gear pump embodying the present invention. The gear pump includes a pump casing indicated generally by the reference character 10 which comprises a head 10a, a pump housing 10b and a backhead 10c. The three casing components are bolted together by a plurality of bolts 12, 13. The pump members 10a, 10b and a sleeve-like insert 14 together define a pumping chamber 16. A rotor 18 is rotatable within the pumping chamber 16 including a plurality of radially extending teeth 18a. The head 10a mounts a fixed idler pin 20 which rotatably supports an idler gear 24 that is in meshing relationship with the peripheral teeth 18a of the rotor 18. In the illustrated embodiment, the idler gear 24 includes a bushing 25.

The rotor 18 is driven by an external drive motor (not shown) through a drive shaft 26. The drive shaft 26 extends through the backhead 10c and is engaged by an interference fit in a central bore 28 formed in the rotor 18. A set screw 30 is used to lock the rotor 18 to the shaft 28.

Figure 2:
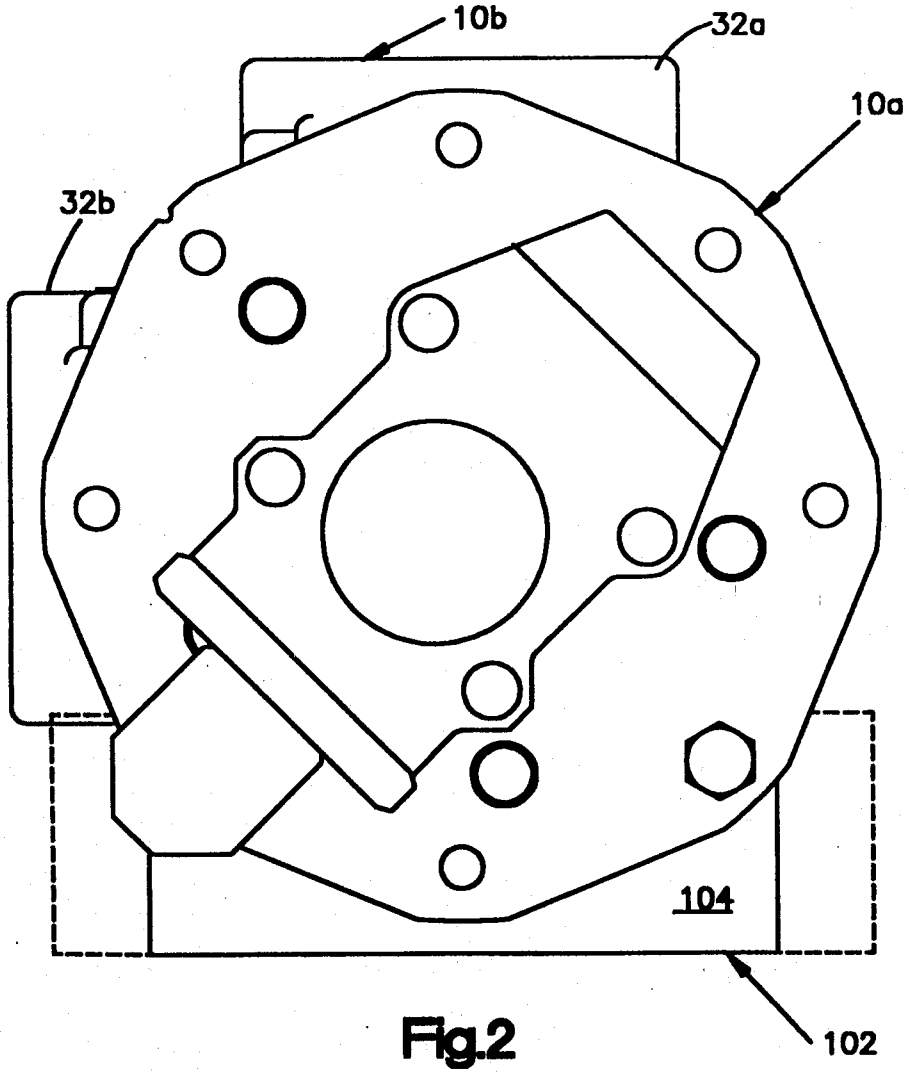
FIG. 2 is a left end view of the pump shown in FIG. 1.

The pump housing 10b defines ports 32a, 32b only one of which is shown in FIG. 1. Both ports 32a, 32b are shown in FIG. 2. The ports 32a, 32b may include threaded portions 33 or flanged portions (not shown) by which connections to conduits, etc. can be made. A crescent 34 is integrally formed in the head 10a and is positioned between a peripheral portion of the idler gear 24 and an inner peripheral region of the outer rotor teeth 18a.

Figure 3A:
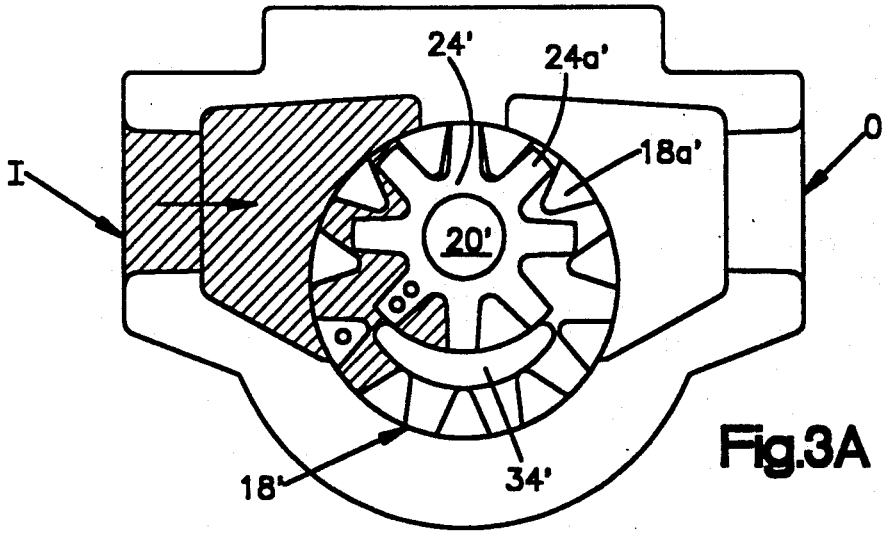
FIGS. 3A-3C are schematic drawings illustrating the principle of operation of a gear within a gear transfer pump.
Figure 3B:
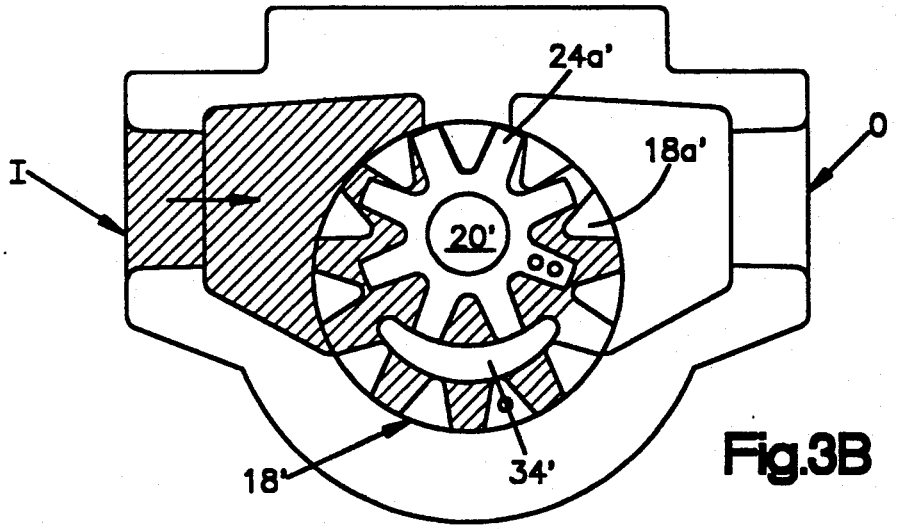
Figure 3C:
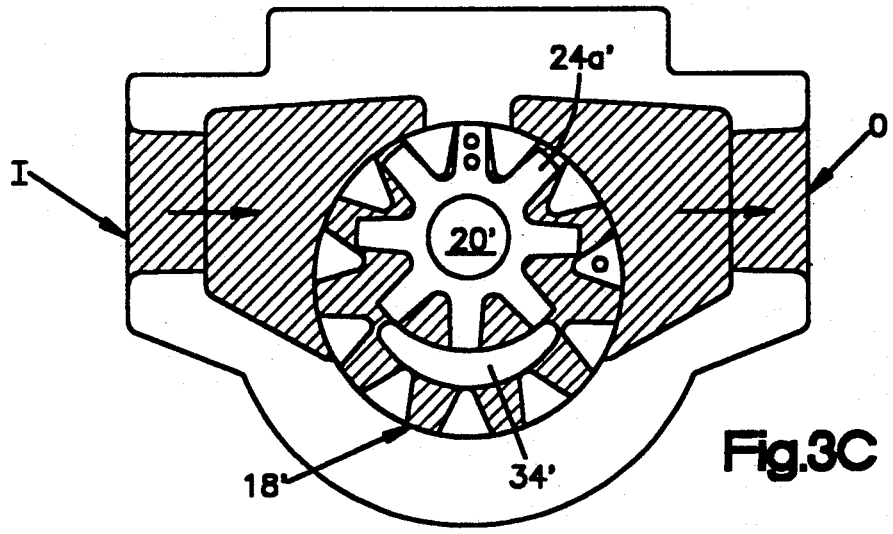

FIGS. 3A–3B illustrate schematically the operation of the transfer gear pump. As seen in FIG. 3A, fluid at an inlet "I" is drawn into the spaces between the gear teeth 24a' of the idler gear 24' as the teeth come out of mesh with the rotor 18' and rotor teeth 18a'. The fluid trapped in the pockets defined between the teeth 18a', 24a' and the crescent 34' (FIG. 3B) is conveyed to the discharge side of the pump where the teeth remesh forcing the captured fluid into an outlet "0" (FIG. 3C). Continuous rotation of the rotor 18' (via an external drive motor, not shown) thus transfers fluid from the inlet "I" to the outlet "O" under pressure.

Returning now to FIG. 1, at least a portion of the periphery of the rotor 18 is rotatably supported by an annular bearing 40 which is press fitted into the housing 10b. In the preferred and illustrated embodiment, the annular bearing 40 surrounds and confronts a peripheral surface 42 of the rotor 18. This portion of the rotor is termed a "skirt". In the preferred and illustrated embodiment, the axial dimension of the bearing is chosen so that the bearing is substantially coextensive with the skirt.

The use of the rotor bearing 40 enables the pump to operate at higher pressures as compared to prior art pumps. In transfer pumps of this type, discharge pressure exerted on portions of the rotor 18 can cause shaft deflection in the shaft 26 and radial movement in the rotor 18 toward the pump cavity wall 16a. In prior art pumps, this deflection caused premature wear of the rotor and/or portions of the internal wall 16a of the pumping cavity 16. In addition, this shaft deflection could place strain on the idler pin 20 due to the resulting misalignment of the rotor gear teeth 18a and the idler gear teeth 24a.

In the preferred embodiment, the bearing is constructed from a material that includes teflon-bronze-steel (TBS). In particular, the bearing 40 preferably comprises steel backed, teflon impregnated bronze. For certain applications other materials may be employed.

The use of the annular rotor bearing 40 substantially eliminates the effects of "over hung" loads on the rotor which in prior art pumps caused undesirable shaft deflection and premature wear in the housing. In addition, the annular rotor bearing 40 can serve as a replaceable wear item eliminating the necessity of replacing the entire housing 10b, should wear in the annular rotor bearing 40 occur.

The shaft 26 is rotatably supported by a bushing 44 press fitted into the sleeve-like housing insert 14. An opposite end of the shaft 26 is supported in a conventional, ball bearing assembly 46. The use of the annular rotor bearing 40 also reduces the radial load on the shaft bearing 46.

To promote cooling and lubricating of the idler pin 20 and idler bushing 25, a fluid circuit is provided for conveying fluid to the idler pin 20. In the disclosed embodiment, the cooling/lubricating circuit forms part of a pressure balancing circuit. In particular, the pressure balancing circuit introduces fluid under pressure to a back side 50 of the rotor 18 to further reduce unbalanced axial loading on the rotor 18. The pressurized fluid communicated to the back side 50 of the rotor 18, at least partially counters axial forces exerted on the rotor 18, urging it towards the right as seen in FIG. 1, by pressurized fluid at or near the discharge port. The pressure balancing circuit also reduces the axial loading of the shaft bearing 46.

Figure 4:
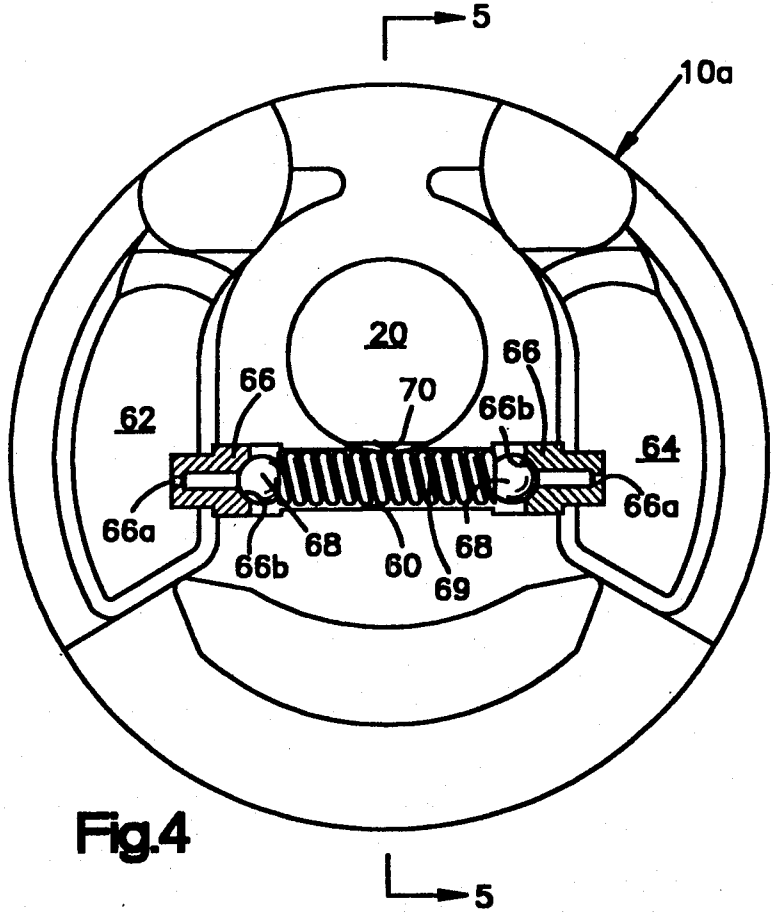
FIG. 4 is a front elevational view of a pump head constructed in accordance with the preferred embodiment of the invention.
Figure 5:
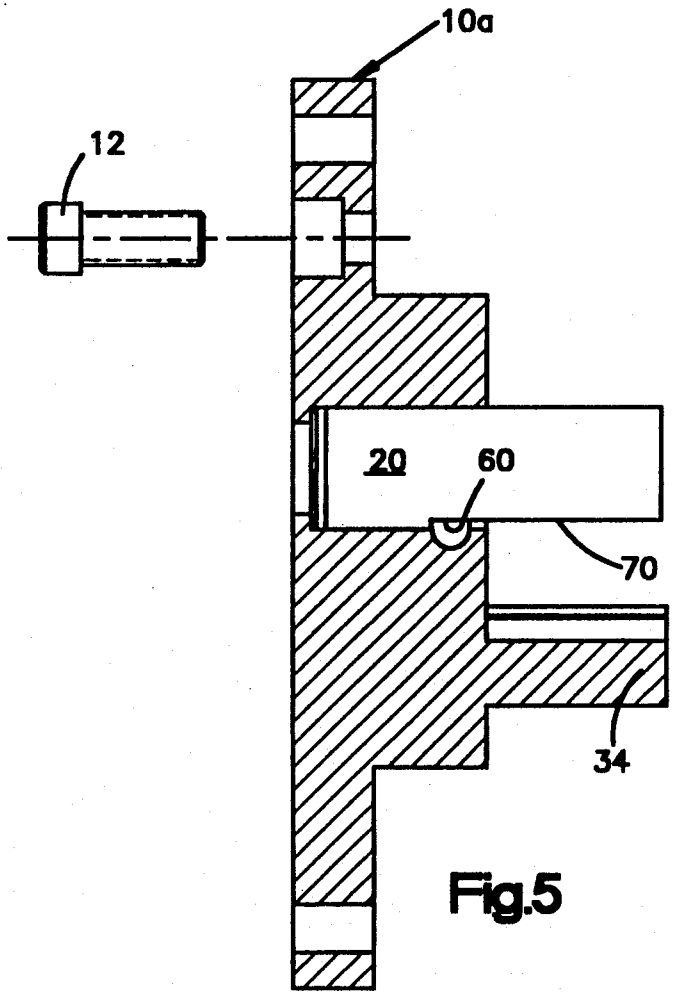
FIG. 5 is a sectional view of the pump head as seen from the plane indicated by the line 5—5 in FIG. 4 with certain parts omitted for clarity.

Referring also to FIGS. 4 and 5, in the preferred and illustrated embodiment, the pump is bi-rotational so that the direction of rotation of the rotor determines which of the ports 32a, 32b is the inlet port and which is the outlet port. In accordance with this feature, the pressure balancing circuit includes a drilled passage 60 formed in the head 10a. As seen best in FIG. 4, the passage 60 extends between and cross-communicates port regions 52, 53 on the head 10a. In other words, the passage 60 communicates with both ports. Orifice plugs 66 are fixed at opposite ends of the passage 60 and each plug defines an associated orifice 66a which restricts flow into the passage 60 from an associated port region. The orifice plugs 66 each define valve seats 66b against which check balls 68 are spring biased by a compression spring 69. Each check ball 68 allows fluid flow from a an associated port into the passage 60 but prevents reverse flow.

In pump operation, the check valve (formed by the orifice plug 66 and check ball 68) communicating with the discharge port will open under the influence of the high pressure and communicate the discharge port with the passage 60. Since the discharge pressure of the pump is higher than inlet pressure, the check ball 68 associated with the inlet port will remain closed under the influence of the discharge pressure in the passage 60 and the force of the spring 69.

The discharge fluid conveyed to the passage 60 through the associated check valve is communicated to a passage 70 defined by the idler pin 20. In the preferred embodiment, the passage 70 is defined by a flat formed on the pin. The flat extends along the pin an axial distance sufficient to communicate the passage 60 with the inner end of the pin (shown best in FIG. 5. The idler pin passage communicates the fluid from the cross passage 60 to a region 72 (shown in FIG. 1) located between the idler gear 24 and the inner end of the rotor drive shaft 26. A drilled passage 74 that extends diagonally through a portion of the inner end of the drive shaft 26 and through a portion of the rotor 18, communicates fluid in the region 72 to the backside 50 of the rotor 18. The pressure communicated to the backside 50 of the rotor 18 generates a force urging the rotor towards the left as viewed in FIG. 1 in opposition to the force exerted by discharge pressure at the discharge port which urges the rotor towards the right.

In the preferred embodiment, the pressurized fluid communicated to the backside 50 of the rotor 18 is less than discharge pressure so that the net force on the rotor urges it towards the right (as viewed in FIG. 1). The disclosed pressure balancing arrangement ensures that the rotor 18 remains in its rightmost position shown in FIG. 1. In this arrangement, the loading on the ball bearings 46 is substantially reduced but not eliminated. As a result, the disclosed rotary pump can operate at a much higher pressure than otherwise would be possible with more conventional constructions.

As indicated above, the disclosed pressure balancing circuit not only balances some of the forces on the rotor 18 but also provides lubrication and cooling to the idler pin 20 and the idler gear bushing 25. As the fluid travels along the passage 70, it carries away heat generated by the idler bushing 25 as it rotates on the idler pin 20 during pump operation. It should be understood that for some applications, the cooling/lubricating aspect of this invention feature may be used without the pressure balancing aspect.

According to another feature of the invention, the shaft bushing 44 which rotatably supports the inner end of the drive shaft 26, serves as a throttle bushing, restricting fluid flow into a seal cavity 76 from the backside 50 of the rotor 18. The seal cavity 76 is defined by the backhead 10c and the insert 14. The throttle bushing 44 is press fitted in the insert 14. A seal assembly 78 inhibits fluid leakage out of the pump casing 10 and in particular, inhibits leakage between the rotating drive shaft 26 and the backhead 10c.

According to another feature of the invention, the pumping fluid that flows past the throttle bushing into the seal chamber is vented to the inlet port so that the seal chamber pressure remains very low and thus reduces seal face loading and resultant wear. In addition, the fluid communicated to the seal chamber 76 cools the seal 78. This feature of the invention also enables the use of lip type seals in the backhead 10c.

According to this feature of the invention, a passage 80, controlled by a check valve 90 communicates the seal chamber 76 with the inlet port 32a. In the preferred and illustrated embodiment, the passage 80 communicates with the check valve 90 via an annular groove 91.

In the preferred and illustrated embodiment, a check valve 90 is provided for each port 32a, 32b (the check valve for the port 32b is not shown) so that the 32b also communicates with the annular groove 91.

As seen in FIG. 1, passage 80 is formed from a set of intersecting bores 92, 94 drilled in the backhead insert 14. The annular groove 91 intersects the upper end of the bore 94. A housing groove 95 aligns with annular grove 91 and adjoins the check valve 90. A multi-stepped bore 96, including tapped portions, is formed in the housing 10b. The stepped bore 96 is adapted to receive a threaded plug 98 which seals the bore after assembly. When engaged in a tapped bore portion 97, a check valve plug 90a provides a seat against which check valve ball 90b is spring biased by spring 100. The check ball 90b allows the flow of fluid from the seal cavity 76 through an orifice 99 while restricting flow in the reverse direction.

In operation, when the seal chamber 76 reaches or exceeds check valve pressure (which is usually the sum of inlet pressure and spring pressure), the check ball associated with the inlet port will open to allow fluid from the seal chamber 76 to flow into the suction/inlet port. High pressure at the outlet or discharge port will maintain closure of the check ball associated with that port.

As indicated above, in many applications, the disclosed transfer gear pump is driven directly by a drive motor that is coupled directly to the external end of the drive shaft 26. The distance between the center line of the motor drive shaft and the motor mounting surface is generally determined by the frame size of the motor selected and varies with motor size. With prior constructions, the transfer gear pump was blocked/spaced in order to position the drive motor so that the drive shaft axis was coincident with the drive motor axis.

In the disclosed embodiment, the disclosed transfer pump includes a replaceable foot bracket 102 that includes upturned flanges 104 that are bolted to spaced apart lugs 106, 108 formed on the pump head 10a and backhead 10c, respectively by bolts 110. A series of foot brackets are provided which correspond to drive motor frame sizes so that a customer upon ordering a pump can specify a given foot bracket, corresponding to the motor size that will be used to drive the pump. By using the appropriate foot bracket, the gear pump merely has to be mounted to the same mounting surface as the drive motor and the axis of the rotor shaft 26 and drive motor will be coincident and direct coupling can be easily effected. This facilitates the installation and/or replacement of a transfer pump for a given application.

Figure 6:
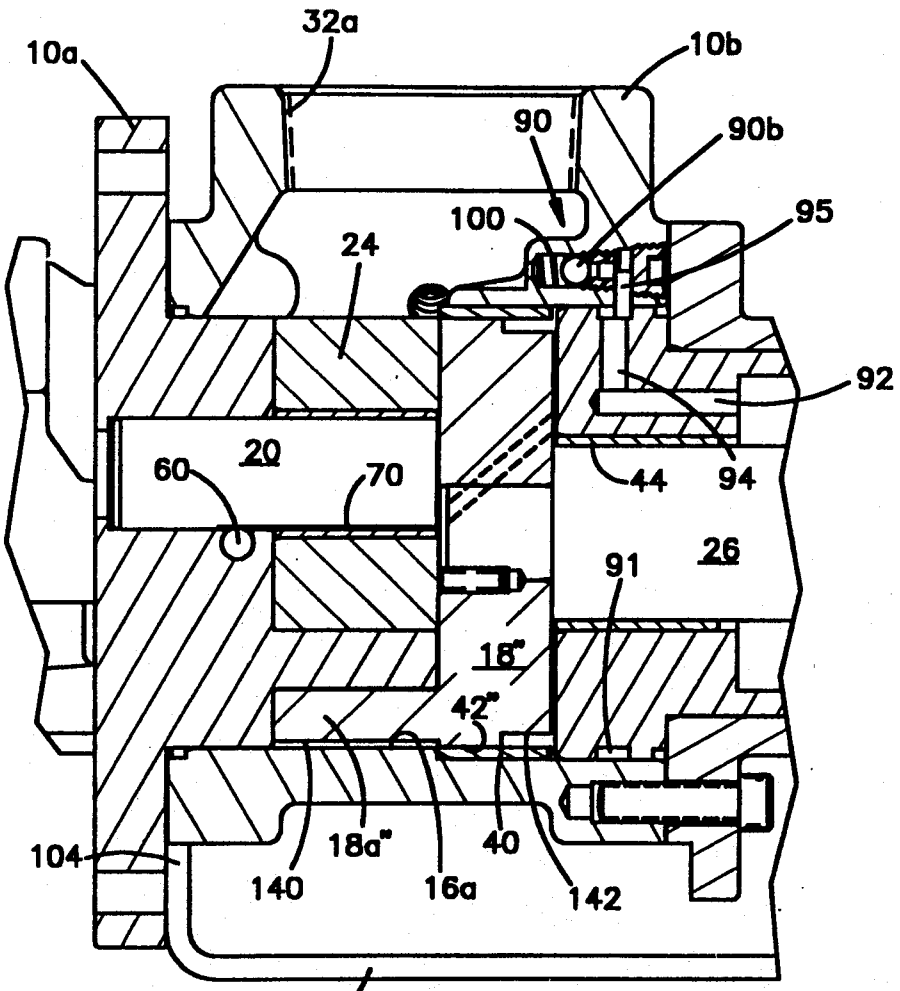
FIG. 6 is a fragmentary, sectional view of the transfer pump showing an alternate rotor configuration.

FIG. 6 illustrates an alternate construction for a rotor which improves the operating efficiency of the pump when pumping high viscous fluids. For purposes of explanation, elements of the alternate rotor which are similar to previously described elements will be designated with an ".

As seen in FIG. 6, the alternate rotor 18" includes regions on its peripheral surface that are "trimmed". In particular, these trimmed regions are designated by the reference characters 140, 142. In effect, the diameter of the rotor 18" is reduced in these regions to provide added clearance between the rotor peripheral surface and the pump cavity wall 16a. The region 140 defines a substantial clearance between the teeth 18a" and the pump chamber wall 16a. The region 142 defines a substantial clearance between a portion of the skirt and the annular bearing 40.

As seen in FIG. 6, a substantially reduced portion of the peripheral surface 42" is in confronting contact with the annular bearing 40. The increased clearances afforded by the regions 140 and 142 reduce viscous friction and reduce the power requirements for driving the pump thereby increasing its efficiency. The non-trimmed portion of the skirt, however, continues to serve as a bearing support and continues to bear the radial loads exerted on the rotor 18". Due to the increased viscosity of the high viscous fluids being pumped, the bearing area can be reduced without substantially affecting the life or operation of the pump.

In the preferred and illustrated embodiment, the full axial length of the teeth 18a'' are trimmed. The skirt of the rotor 18'' is trimmed approximately ⅓ its axial length. In addition, in the most preferred embodiment, the clearance defined in the region 142 is substantially twice the clearance defined by the region 140. It should be understood however, that for particular applications, the trim length of the rotor teeth 18a'' and rotor skirt as well as the extent of the reduction in the diameter in the regions 140, 142 may be varied to accommodate particular applications or operating environments.

It should be apparent that the present invention provides a substantially improved "gear within a gear" transfer pump capable of being operated at relatively high operating pressures (for this type of pump). In addition, it is believed that the construction of the disclosed pump will have enhanced reliability and serviceability.

Although the invention is described with a certain degree of particularity it should be understood that those skilled in the art can make various changes to it without departing from the spirit or scope of the invention as herein after claimed.

We claim:

1. A rotary, gear transfer pump, comprising:

(a) a pump housing defining a circular pumping chamber communicating with a first port and a second port;

(b) a rotor rotatable within said chamber including:

(i) a plurality of spaced apart teeth extending axially from a skirt portion of said rotor;

(ii) a drive shaft extending axially from said skirt portion and defining a rotational axis for said rotor;

(c) a seal chamber defined by said housing spaced axially from said pump chamber;

(d) a bushing for supporting said drive shaft located intermediate said pump chamber and said seal chamber;

(e) an idler gear rotatable on an idler pin extending into said pumping chamber and positioned such that said idler gear is in meshing engagement with said rotor and is driven thereby; and, (f) a non-elastomeric annular bearing means mounted in said housing and in confronting relation with said skirt portion of said rotor, said baring being substantially coextensive with said skirt portion.

2. The apparatus of claim 1 further comprising pressure balancing means for reducing axial loading of said rotor including passage means communicating fluid under pressure from one of said ports to a backside region of said rotor such that forces generated by said fluid under pressure on said backside region oppose, at least partially, axial forces exerted on said rotor by fluid in said pumping chamber.

3. A rotary, gear transfer pump, comprising:

(a) a pump housing defining a circular pumping chamber communicating with a first port and a second port;

(b) a rotor rotatable within said chamber including:

(i) a plurality of spaced apart teeth extending axially from a skirt portion of said rotor;

(ii) a drive shaft extending axially from said skirt portion and defining a rotational axis for said rotor;

(c) a seal chamber defined by said housing spaced axially from said pump chamber;

(d) an idler gear rotatable on a fixed idler pin extending into said pumping chamber and positioned such that said idler gear is in meshing engagement with said rotor and is driven thereby; and, (e) fluid circuit means for lubricating and cooling said idler pin during pump operation including means communicating fluid from one of said ports to a passage means defined by said idler pin, said passage means including an axially extending flat formed on said idler pin, one of said flat communicating with said one port.

4. The pump of claim 3 wherein said fluid circuit means includes pressure balancing means for reducing axial loading of said rotor including balancing passage means communicating fluid under pressure from one of said ports to a backside region of said rotor such that forces generated by said fluid under pressure on said backside region oppose, at least partially, axial forces exerted on said rotor by fluid in said pumping chamber.

5. The rotary transfer pump of claim 3, wherein said pump housing further includes a crescent positioned between teeth of said idler gear and teeth of said rotor and said flat formed on said idler pin is orientated toward said crescent.

6. The rotary transfer pump of claim 3, wherein said flat on said idler pin is located on an imaginary line extending through an axis of rotation for said idler gear and an axis of rotation for said rotor and is orientated away from a region of gear mesh between the idler gear and rotor.

7. A rotary, gear transfer pump, comprising:

(a) a pump housing defining a circular pumping chamber communicating with a first port and a second port;

(b) a rotor rotatable within said chamber including:

(i) a plurality of spaced apart teeth extending axially from a skirt portion of said rotor;

(ii) a drive shaft extending axially from said skirt portion and defining a rotational axis for said rotor;

(c) a seal chamber defined by said housing spaced axially from said pump chamber;

(d) an idler gear rotatable on a idler pin extending into said pumping chamber and positioned such that said idler gear is in meshing engagement with said rotor and is driven thereby;

(e) an annular bearing means mounted in said housing and in confronting relation with a peripheral surface of said rotor; and, (f) said pump housing further including a pair of spaced apart mounting lugs depending from said housing;

(g) a removable mounting bracket supporting said pump housing such that a centerline of said transfer pump is maintained at a desired operating height determined by a selected mounting bracket, said mounting bracket including mounting elements attachable to said mounting lugs.

8. A rotary, gear transfer pump, comprising:

(a) a pump housing defining a circular pumping chamber communicating with a first port and a second port;

(b) a rotor rotatable within said chamber including:

(i) a plurality of spaced apart teeth extending axially from a skirt portion of said rotor;

(ii) a drive shaft extending axially from said skirt portion and defining a rotational axis for said rotor;

(c) a seal chamber defined by said housing spaced axially from said pump chamber;

(d) a bushing for supporting said drive shaft located intermediate said pump chamber and said seal chamber;

(e) an idler gear rotatable on an idler pin extending into said pumping chamber and positioned such that said idler gear is in meshing engagement with said rotor and is driven thereby; and, (f) pressure balancing means for reducing axial loading of said rotor including passage means communicating fluid under pressure from one of said ports to a backside region of said rotor such that forces generated by said fluid under pressure on said backside region oppose, at least partially, axial forces exerted on said rotor by fluid in said pumping chamber;

(g) said pressure balancing means defined in part by an axially extending flat formed on the exterior of said idler pin, one end of said flat in fluid communication with said fluid under pressure and the other end of said flat communicating with a front side region defined between an inner end of said pin and a central portion of said rotor;

(h) said pressure balancing means further including a passage extending through said rotor from said front side region and said backside region.

9. The apparatus of claim 8 further comprising vent passage means for communicating fluid in said seal chamber to the other of said ports.

10. The pump of claim 8 wherein said skirt portion of said rotor defines a trimmed region for providing a predetermined clearance between said skirt portion and said pump housing that is greater than a clearance between peripheral surfaces on said rotor teeth and said pump housing.

11. A rotary, gear transfer pump, comprising:

(a) a pump housing defining a circular pumping chamber communicating with a first port and a second port;

(b) a rotor rotatable within said chamber including:

(i) a plurality of spaced apart teeth extending axially from a skirt portion of said rotor;

(ii) a drive shaft extending axially from said skirt portion and defining a rotational axis for said rotor;

(c) a seal chamber defined by said housing spaced axially from said pump chamber;

(d) a bushing for supporting said drive shaft located intermediate said pump chamber and said seal chamber;

(e) an idler gear rotatable on an idler pin extending into said pumping chamber and positioned such that said idler gear is in meshing engagement with said rotor and is driven thereby; and, (f) pressure balancing means for reducing axial loading of said rotor including passage means communicating fluid under pressure from one of said ports to a backside region of said rotor such that forces generated by said fluid under pressure on said backside region oppose, at least partially, axial forces exerted on said rotor by fluid in said pumping chamber; and (g) a non-elastomeric annular bearing means mounted in said housing and in confronting relation with said skirt portion of said rotor, said bearing means being substantially coextensive with said skirt portion;

(h) said skirt portion of said rotor defining a trimmed region defined by a reduced diameter section on said skirt portion for providing a predetermined clearance between said trimmed region of said skirt portion and said annular bearing means that is greater than a clearance between peripheral surfaces on said rotor teeth and said pump housing.

12. The pump of claim 11 wherein said trimmed region extends for substantially ⅔ of the axial length of said skirt portion.

13. A rotary, gear transfer pump, comprising:

(a) a pump housing defining a circular pumping chamber communicating with a first port and a second port;

(b) a rotor rotatable within said chamber including:

(i) a plurality of spaced apart teeth extending axially from a skirt portion of said rotor;

(ii) a drive shaft extending axially from said skirt portion and defining a rotational axis for said rotor;

(c) a seal chamber defined by said housing spaced axially from said pump chamber;

(d) a bushing for supporting said drive shaft located intermediate said pump chamber and said seal chamber;

(e) an idler gear rotatable on a fixed idler pin extending into said pumping chamber and positioned such that said idler gear is in meshing engagement with said rotor and is driven thereby;

(f) an annular bearing means mounted in said housing and in confronting relation with a peripheral surface of said rotor;

(g) pressure balancing means for reducing axial loading of said rotor including passage means communicating fluid under pressure from one of said ports to a backside region of said rotor such that forces generated by said fluid under pressure on said backside region oppose, at least partially, axial forces exerted on said rotor by fluid in said pumping chamber, said passage means defined in part by:

(i) a fluid channel formed on the exterior of said idler pin;

(ii) a confronting region located between an end of said idler pin and a front side of said rotor; and, (iii) a passage formed in said rotor that opens onto a front side region and said backside region of said rotor and communicates with said confronting region;

(iv) said fluid channel communicating said fluid under pressure with said confronting region;

(h) vent passage means for communicating fluid in said seal chamber to the other of said ports; and (i) removable mounting means supporting said pump housing at a predetermined operating height.

14. The pump of claim 13 wherein said fluid channel defined by said idler pin is formed by a flat on said pin.

15. The pump of claim 13 wherein said one port forms a discharge port and said other port forms a suction port.

16. The pump of claim 1 wherein said vent passage means includes first and second check valves associated with said first and second ports, respectively, each of said check valves communicating with said seal chamber through a passage means, said first and second check valves allowing fluid flow from said seal chamber to an associated port when fluid pressure in said seal chamber exceeds a predetermined pressure at an associated port while inhibiting reverse flow.

17. The rotary gear transfer pump of claim 13, wherein said fluid channel formed on the exterior of said idler pin comprises an axially extending flat.

18. The pump of claim 13 wherein said vent passage means includes a passage communicating said seal chamber with a common passage means, first and second check valves associated with said first and second ports, respectively, each of said check valves communicating with said common passage means, said first and second check valves allowing fluid flow form said seal chamber to an associated port while inhibiting reverse flow.

19. The pump of claim 18 wherein said common passage means comprises an annular groove formed in a pump member.

20. The pump of claim 13 wherein said pressure balancing passage means further includes a cross passage communicating said one port with said other port and further including means for communicating said cross passage with said idler pin channel; and, check valve means associated with each port and operative to allow fluid flow from an associated port into said cross passage while inhibiting reverse flow.

21. The apparatus of claim 20 wherein said cross passage includes valve seats disposed near ends of said passage and further including spring biasing means and valve elements associated with said seats, said valve elements biased towards engagement with associated seats by said spring biasing means.

* * * * *